US005288590A

United States Patent [19]

Kuwabara et al.

[11] Patent Number: 5,288,590

[45] Date of Patent: Feb. 22, 1994

[54] HIGH-CONTRAST SILVER HALIDE PHOTOGRAPHIC MATERIAL AND METHOD FOR FORMING AN IMAGE WITH THE SAME

[75] Inventors: Ken-ichi Kuwabara; Takashi Hoshimiya, both of Kanagawa, Japan

[73] Assignee: Fuji Photo Film Co., Ltd., Kanagawa, Japan

[21] Appl. No.: 934,232

[22] Filed: Aug. 25, 1992

[30] Foreign Application Priority Data

Sep. 2, 1991 [JP] Japan ..... 3-246496

[51] Int. Cl.[5] ..... G03C 1/06

[52] U.S. Cl. ..... 430/264; 430/598; 430/603; 430/604; 430/605; 430/410; 430/435; 430/439; 430/440; 430/487

[58] Field of Search ..... 430/264, 598, 603, 604, 430/605, 410, 435, 439, 440, 487

[56] References Cited

U.S. PATENT DOCUMENTS

| | | | |
|---|---|---|---|
| 4,621,041 | 11/1986 | Saikawa et al. | 430/604 |
| 4,681,836 | 7/1987 | Inoue et al. | 430/440 |
| 4,988,604 | 2/1991 | Machonkin et al. . | |
| 4,994,365 | 2/1991 | Looker et al. | 430/598 |
| 5,039,591 | 8/1991 | Okutsu et al. | 430/264 |
| 5,041,355 | 8/1991 | Machonkin et al. | 430/264 |
| 5,126,227 | 6/1992 | Machonkin et al. | 430/264 |
| 5,175,073 | 12/1992 | Gingello et al. | 430/264 |
| 5,196,292 | 3/1993 | Machonkin et al. | 430/264 |

FOREIGN PATENT DOCUMENTS 2-300747 12/1990 Japan .

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A high contrast photographic image is formed by development of a photographic material with an amine-free developer having a low pH value. The photographic material has at least one silver halide emulsion on a support. The silver halide emulsion in the emulsion layer contains an iridium salt and/or a rhodium salt and comprises a gold-sensitized and sulfur-sensitized silver chlorobromide emulsion or silver chloroiodobromide emulsion having a silver chloride content of 50 mol% or more and a silver iodide content of 5 mol% or less. The emulsion layer contains a hydrazine compound represented by formula (I):

$$R_1-\underset{\underset{A_1}{|}}{N}-\underset{\underset{A_2}{|}}{N}-G_1-R_2 \qquad (I)$$

wherein $R_1$ represents an aliphatic group or an aromatic group, which contains a partial structure, $-O-(CH_2CH_2O)_n-$, $-O-(CH_2CH(CH_3)O)_n-$ or $-O-(CH_2CH(OH)CH_2O)_n-$, wherein n is an integer of 3 or more, as a part of the $R_1$ substituent, or contains a quaternary ammonium cation as a part of the $R_1$ substituent; $G_1$ represents $-CO-$, $-COCO-$, $-CS-$, $-C(=NG_2R_2)-$, $-SO-$, $-SO_2-$ or $-P(O)(G_2R_2)-$, wherein $G_2$ represents at least one chemical bond selected from the group consisting of $-O-$, $-S-$ or $-N(R_2)-$, and $R_2$ represents an aliphatic group, an aromatic group or a hydrogen atom. When the molecule has a plurality of $R_2$ groups, they may be same as or different from each other. One of $A_1$ and $A_2$ is a hydrogen atom, and the other is a hydrogen atom, an acyl group, an alkylsulfonyl group or an arylsulfonyl group.

6 Claims, No Drawings

HIGH-CONTRAST SILVER HALIDE PHOTOGRAPHIC MATERIAL AND METHOD FOR FORMING AN IMAGE WITH THE SAME

FIELD OF THE INVENTION

The present invention relates to a silver halide photographic material for use in photomechanical processes, which has extremely hard photographic characteristics. The invention also relates to a method for forming images with the material. In particular, it relates to a method for rapidly forming a high contrast image with a high resolving power, using highly stable processing solutions.

BACKGROUND OF THE INVENTION

In the photoengraving step in the field of photographic printing and duplication, a method is generally employed in which a photographic image having continuous gradation is converted into a so-called dot image, expressing the light and shade of the image in accordance with the size of various dot areas constituting the image. The dot image is combined with a letter image, a line image to give a printing plate.

The silver halide photographic material used in this method must have so-called ultra-hard photographic characteristics with a high contrast and a high blacking density, clearly distinguishing the image area from the non-image area. These characteristics result in good reproducibility of clearly reproducing letters, line images and dot images.

To attain this purpose, a method for forming a photographic image having a high contrast and a high blacking density has heretofore been employed In that method, the photographic material with a silver chlorobromide emulsion (i.e., one having a silver chloride content of 50 mol% or more) is processed with a hydroquinone developer (lith developer) having an extremely low effective sulfite ion concentration (generally, 0.1 mol% or less). Silver halide photographic materials of the kind are known as lith photographic materials.

However, since a lith developer, having a low sulfite ion concentration, easily undergoes aerial oxidation and its preservability is extremely poor, it is used in continuous operation with various techniques and devices for the purpose of keeping a constant developed quality.

A method for rapidly forming a high contrast image with a processing solution having a good storage stability, while overcoming the instability of the image formed by lith development, has been proposed in U.S. Pat. Nos. 4,166,742, 4,168,977, 4,221,875, 4,224,401, 4,243,739, 4,272,606, 4,311,781 and 4,650,746. The new method is characterized by processing a surface latent image type silver halide photographic material containing a particular hydrazine derivative compound with a superadditive developer containing a sulfite preservative in a high concentration and having a pH value of from 11.0 to 12.3.

In accordance with the new development system, elevation of the stability of the developer used has been made possible by incorporation of a sulfite preservative in a high concentration thereinto. However, in order to obtain a high contrast image by this method, a developer having a pH value higher than that of a conventional lith developer or a rapid access developer is required. Since the pH value of the developer is high, it can not be said to have sufficient stability even though it contains a sulfite preservative of a high concentration. Accordingly, there has been a strong demand for lowering the pH value of the developer.

U.S. Pat. No. 4,269,929 and JP-A-61-267759 (the term "JP-A" as used herein means an "unexamined published Japanese patent application") describe a method for forming a high contrast photographic image with a developer having a lower pH value, in which an amine compound capable of promoting the contrast-elevating activity of hydrazines is added to the developer.

On the other hand, JP-A-60-179734, JP-A-61-170733, JP-A-61-270744, JP-A-62-948, JP-A-63-234244 and JP-A-2-00747 and U.S. Pat. No. 4,798,780 describe various hydrazine derivatives having a high contrast-elevating activity, in which various efforts to elevate the stability i development have been made.

SUMMARY OF THE INVENTION

One object of the present invention is to provide a silver halide photographic material capable of forming a high contrast image with a developer having a low pH value.

Another object of the present invention is to provide a method for forming a high contrast image in which elevation of the contrast of the image with hydrazine derivatives is expressed by an amine compound-free developer having a low pH value.

These and other objects of the present invention have been attained by a silver halide photographic material comprising a support having thereon at least one silver halide emulsion layer, wherein a silver halide emulsion in the emulsion layer contains an iridium salt and/or a rhodium salt and comprises a gold-sensitized and sulfur-sensitized silver chlorobromide emulsion or silver chloro-iodobromide emulsion, having a silver chloride content of 50 mol% or more and a silver iodide content of 5 mol% or less, and the emulsion layer contains a hydrazine compound represented by formula (I):

$$R_1-\underset{\underset{A_1}{|}}{N}-\underset{\underset{A_2}{|}}{N}-G_1-R_2 \qquad \text{(I)}$$

wherein $R_1$ represents an aliphatic group or an aromatic group, which contains a partial structure, $-O\text{-}(CH_2CH_2O)_n-$, $-O\text{-}(CH_2CH(CH_3)O)_n-$ or $-O\text{-}(CH_2CH(OH)CH_2O)_n-$, wherein n is an integer of 3 or more, as a part of the $R_1$ substituent, or contains a quaternary ammonium cation as a part of the $R_1$ substituent; $G_1$ represents —CO—, —COCO—, —CS—, $-C(=NG_2R_2)-$, —SO—, $-SO_2-$ or $-P(O)(G_2R_2)-$, wherein $G_2$ represents at least one chemical bond selected from the group consisting of —O—, —S— or $-N(R_2)-$, and $R_2$ represents an aliphatic group, an aromatic group or a hydrogen atom, and when the molecule has a plurality of $R_2$ groups, they may be same as or different from each other; and one of $A_1$ and $A_2$ is a hydrogen atom, and the other is a hydrogen atom, an acyl group, an alkylsulfonyl group or an arylsulfonyl group.

With the above photographic material of the present invention, formation of a high-contrast negative image is possible with a superadditive developer having a pH value of from 10.0 to 11.5 and having the components (1) to (3) mentioned below even though the developer does not contain an amine in a contrast-promoting amount:

(1) a hydroquinone developing agent;

(2) a 3-pyrazolidone auxiliary developing agent and/or a p-aminophenol auxiliary developing agent in an amount of 0.06 mol/liter or less; and (3) a sulfite ion in a concentration of from 0.3 to 0.8 mol/liter.

DETAILED DESCRIPTION OF THE INVENTION

Hydrazine compounds of formula (I) for use in the present invention will be explained in more detail hereunder.

In formula (I), the aliphatic group represented by $R_1$ is preferably one having from 1 to 30 carbon atoms and is especially preferably a linear, branched or cyclic alkyl group having from 1 to 20 carbon atoms, which has substituent(s).

In formula (I), the aromatic group represented by $R_1$ is preferably a mono-cyclic or bi cyclic aryl group or an unsaturated heterocyclic group, and the unsaturated heterocyclic aryl group may be condensed with an aryl group to form a hetero-aryl group.

For instance, $R_1$ may contain a benzene ring, a naphthalene ring, a pyridine ring, a quinoline ring or an isoquinoline ring. Preferred for $R_1$ is a group of containing a benzene ring.

$R_1$ is especially preferably an aryl group.

The aryl group or unsaturated heterocyclic group represented by $R_1$ is preferably substituted. The aliphatic group or aromatic group represented by $R_1$ is preferably substituted.

Typical substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, and a phosphonic acid amide group. Of them, preferred are a linear, branched or cyclic alkyl group (preferably having from 1 to 20 carbon atoms), an aralkyl group (preferably having from 7 to 30 carbon atoms), an alkoxy group (preferably having from 1 to 30 carbon atoms), a substituted amino group (preferably, an amino group substituted by alkyl group(s) having from 1 to 30 carbon atoms), an acylamino group (preferably having from 2 to 40 carbon atoms), a sulfonamido group (preferably having from 1 to 40 carbon atoms), a ureido group (preferably having from 1 to 40 carbon atoms), and a phosphoric acid amido group (preferably having from 1 to carbon atoms).

The aliphatic group or aromatic group represented or its substituent contains $-O-(CH_2CH_2O)_n-$, $-O-(CH_2CH-(CH_3)O)_n-$ or $-O-(CH_2CH(OH)CH_2O)_n-$ or contains a quaternary ammonium cation. The term n is an integer of 3 or more, preferably an integer of from 3 to 15.

The term $R_1$ preferably represents a compound according to one of the following formulae (2), (3), (4) and (5):

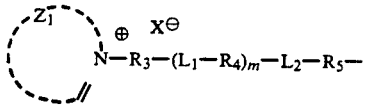

(2)

-continued

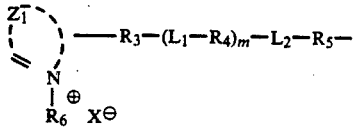

(3)

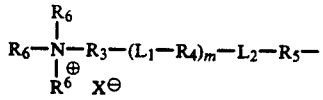

(4)

$$R_6-O-(L_3)_n-R_3-(L_1-R_4)_m-L_2-R_5- \quad (5)$$

In these formulae (2) to (5), $L_1$ and $L_2$ each represents $-CONR_7-$, $NR_7CONR_8-$, $-SO_2NR_7-$ or $-NR_7SO_2NR_8-$, and they may be same as or different from each other. The terms $R_7$ and $R_8$ each represent a hydrogen atom, an alkyl group having from 1 to 6 carbon atoms, or an aryl group having from 6 to 10 carbon atoms; and they are preferably hydrogen atoms. The term m is 0 or 1.

The terms $R_3$, $R_4$ and $R_5$ each represent a divalent aliphatic or aromatic group, preferably an alkylene group or an arylene group or a divalent group formed by combining an alkylene and/or arylene group with $-O-$, $-CO-$, $-S-$, $-SO-$, $-SO_2-$ and/or $-NR_9-$ (where $R_9$ has the same meaning as $R_7$ in formula (2), (3) or (4)).

More preferably, $R_3$ represents an alkylene group having from 1 to 10 carbon atoms or a divalent group formed by combining such an alkylene group with $-S-$, $-SO-$ and/or $-SO_2-$; and $R_4$ and $R_5$ each is an arylene group having from 6 to 20 carbon atoms. The term $R_5$ is especially preferably a phenylene group.

The terms $R_3$, $R_4$ and $R_5$ each may be substituted. The preferred substituents for them are the substituents for $R_1$.

In formulae (2) and (3), $Z_1$ represents an atomic group necessary for forming a nitrogen-containing aromatic ring. Preferred examples of the nitrogen-containing aromatic ring formed by $Z_1$ and the nitrogen atom include a pyridine ring, a pyrimidine ring, a pyridazine ring, a pyrazine ring, an imidazole ring, a pyrazole ring, a pyrrole ring, an oxazole ring, a thiazole ring and benzocondensed rings of them, as well as a pteridine ring and a naphthyridine ring.

In formulae (2), (3) and (4), $X^{\ominus}$ is a counter anion (i.e., a charge balancing anion) or is a counter anion part (i.e., a charge balancing anion part) when the formula forms an intramolecular salt. And m is 0 or 1.

In formulae (3), (4) and (5), $R_6$ represents an aliphatic group or an aromatic group. Preferably, it is an alkyl group having from 1 to 20 carbon atoms or an aryl group having from 6 to 20 carbon atoms.

In formula (4), the three $R_6$ groups may be same as or different from each other, or they may be bonded to each other to form a ring.

The terms $Z_1$ and $R_6$ each may optionally be substituted. The preferred substituents for them are the substituents for $R_1$.

In formula (5), $L_3$ represents $-CH_2CH-O-$, $-CH_2CH(CH_3)O-$, or $-CH_2CH(OH)CH_2O-$; and n has the same meaning as that in formula (I).

In formula (I), $G_1$ is preferably $-CO-$ or $-SO_2-$; and most preferred is $-CO-$.

$A_1$ and $A_2$ are preferably both hydrogen atoms.

In formula (I), the alkyl group represented by $R_2$ is preferably an alkyl group having from 1 to 4 carbon atoms; and the aryl group is preferably a mono-cyclic or bi-cyclic aryl group (for example, containing benzene ring(s)).

When $G_1$ is —CO—, $R_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), or an aryl group (e.g., phenyl, 3,5-dichlorophenyl, o-methanesulfonamidophenyl, 4 methanesulfonylphenyl, 2-hydroxymethylphenyl). It is especially preferably a hydrogen atom.

The term $R_2$ may optionally be substituted. Preferred substituents are the substituents for $R_1$.

The term $R_2$ may be a group that cleaves the moiety of $—G_1—R_2$ from the remaining molecule to cause cyclization forming a cyclic structure containing atoms of the moiety $—G_1—R_2$. Examples of such a group include those mentioned in, for example, JP-A-63-29751.

The term $R_1$ or $R_2$ in formula (I) may have therein a ballast group which is common in ordinary passive photographic additives such as couplers or it may have a polymer. The ballast group may be selected from relatively photographically inert groups having 8 or more carbon atoms, such as an alkyl group, an alkoxy group, a phenyl group, an alkylphenyl group, a phenoxy group and an alkylphenoxy group. The polymer in $R_1$ or $R_2$ include those mentioned in JP-A 1-100530.

The terms $R_1$ or $R_2$ in formula (I) may have therein a group capable of enhancing the adsorbability of the molecule onto the surfaces of silver halide grains. Such an adsorbing group includes, for example, a thiourea group, a heterocyclic thioamide group, a mercapto-heterocyclic group, a triazole group and others as described in U.S. Pat. Nos. 4,385,108 and 4,459,347, and JP-A-59-195233, JP-A-59-200231, JP-A 59-201045, JP-A-59 201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Compounds of formula (I) in the present invention can be produced, for example, by the methods described in JP-A-61-213847 and JP-A-62-260153, U.S. Pat. No. 4,684,604, U.S. Pat. Nos. 3,379,529, 3,620,746, 4,377,634 and 4,332,878, JP-A-1-269936 JP-A-49-129536, JP-A-56-153336 and JP-A-56-153342, and U.S. Pat. Nos. 4,988,604 and 4,994,365.

Specific examples of compounds of formula (I) in the present invention are mentioned below, which, however, are not limiting.

(I-1)

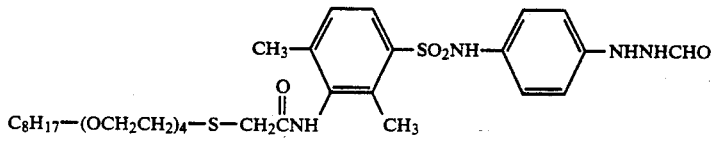

(I-2)

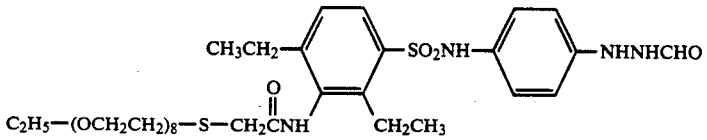

(I-3)

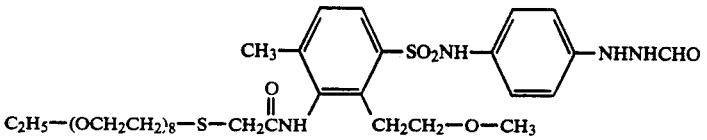

(I-4)

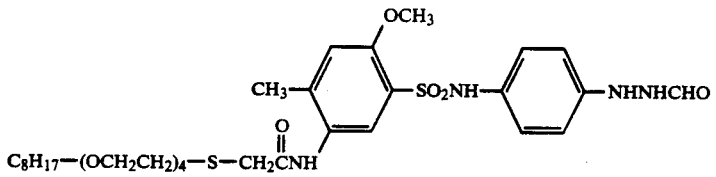

(I-5)

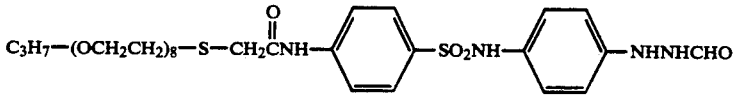

(I-6)

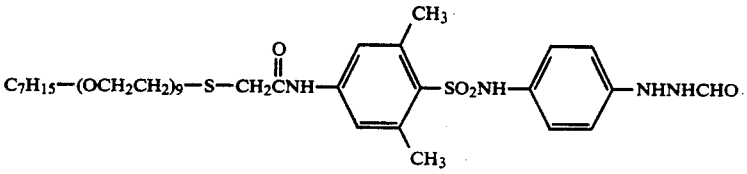

-continued
(I-7)
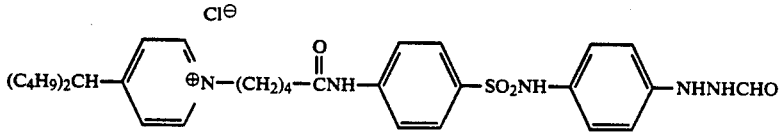
(I-8)
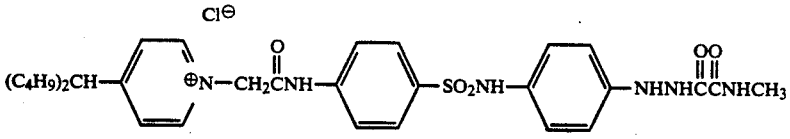
(I-9)
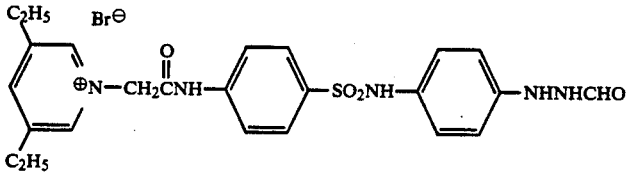
(I-10)
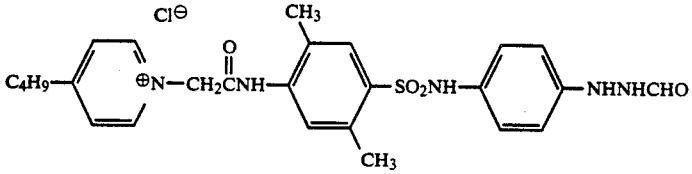
(I-11)
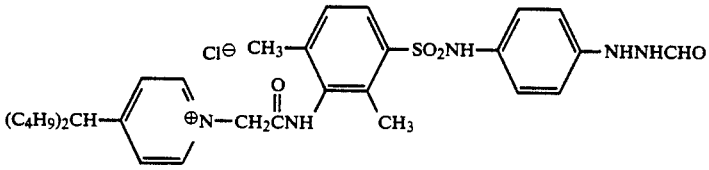
(I-12)
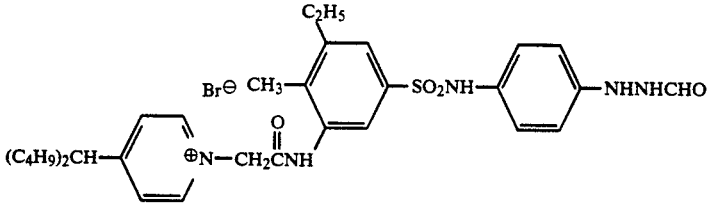
(I-13)
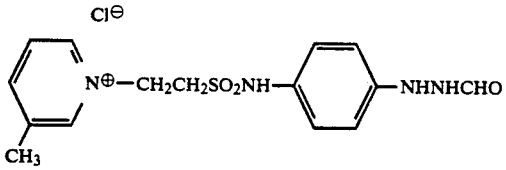
(I-14)
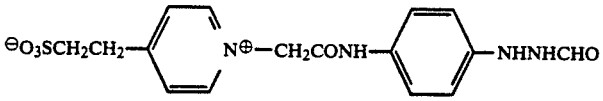
(I-15)
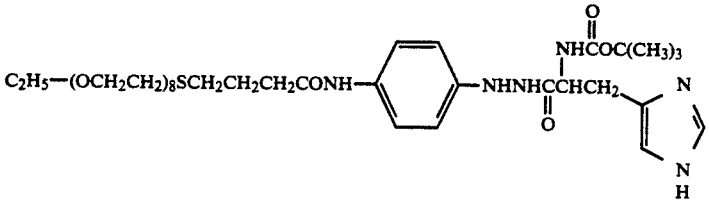

-continued
(I-16)
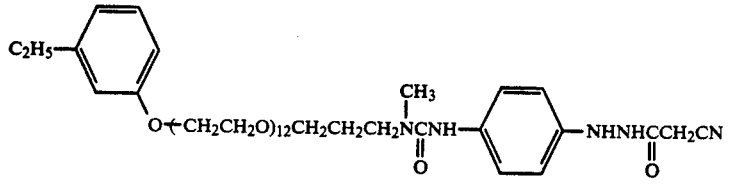
(I-17)
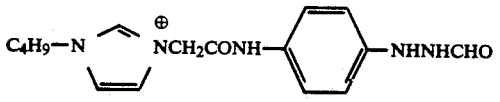
(I-18)
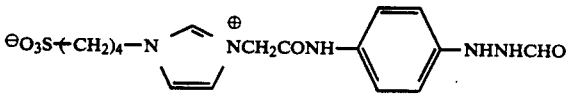
(I-19)
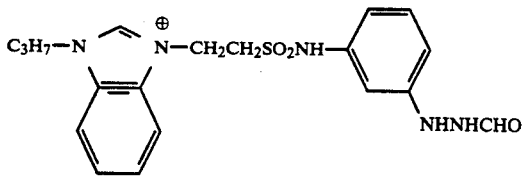
(20)
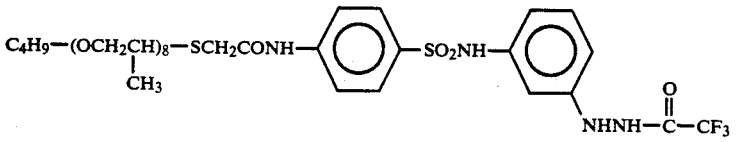
(I-21)
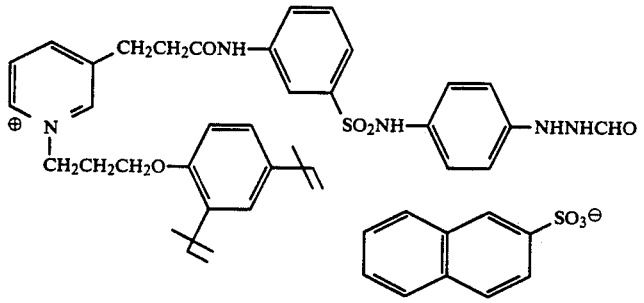
(I-22)
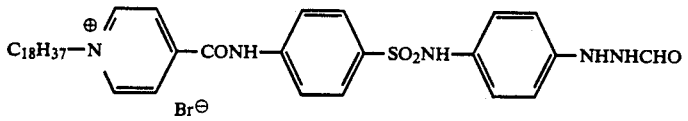
(I-23)
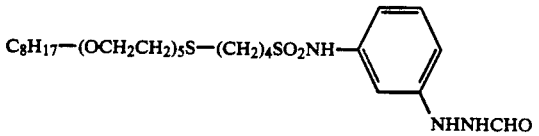
(I-24)
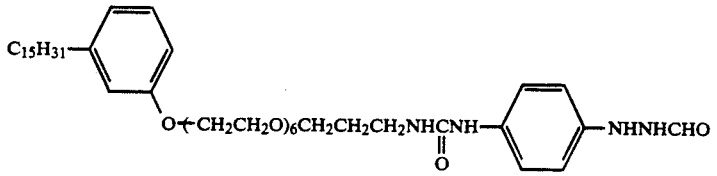

-continued
(I-25)
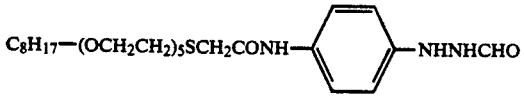
(I-26)
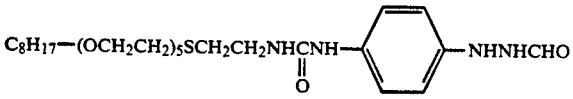
(I-27)
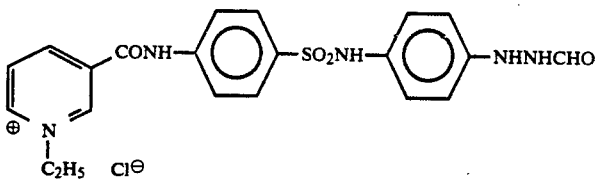
(I-28)
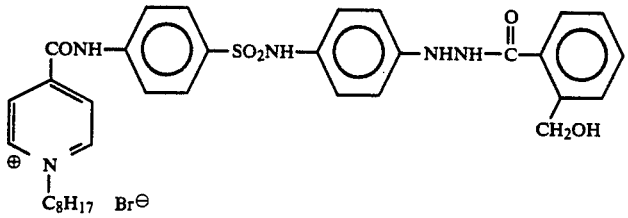
(I-29)
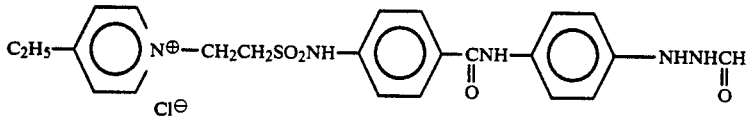
(I-30)
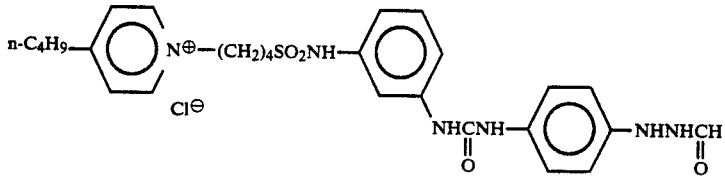
(I-31)
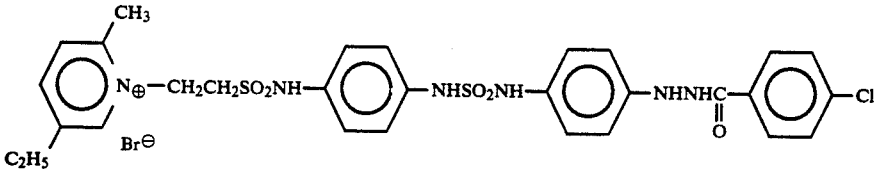
(I-32)
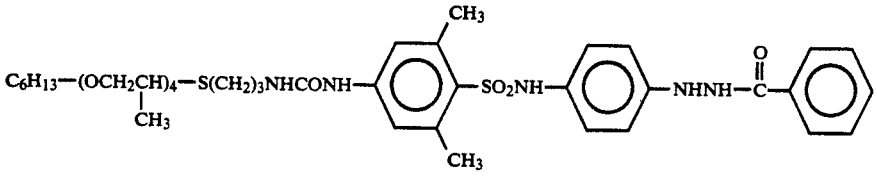
(I-33)
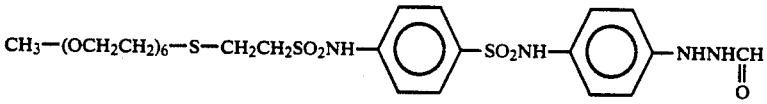
(I-34)
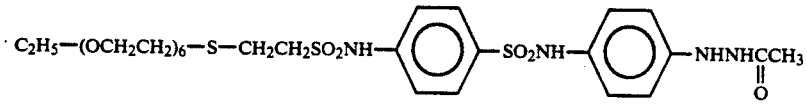

-continued (I-35)

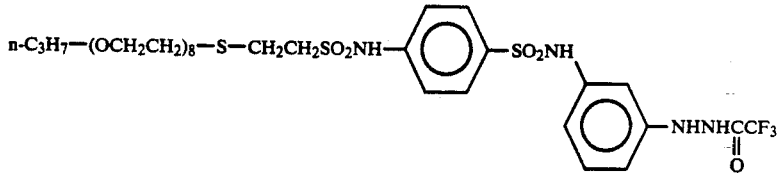

(I-36)

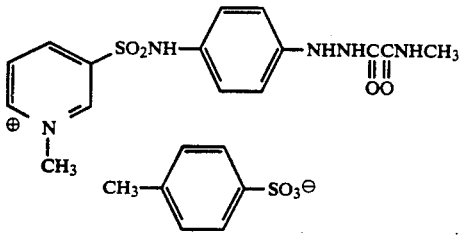

(I-37)

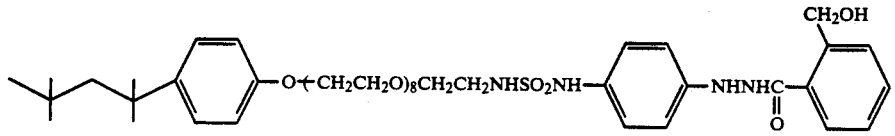

(I-38)

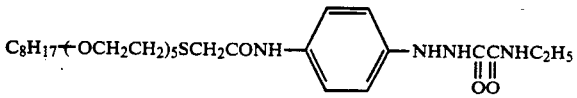

(I-39)

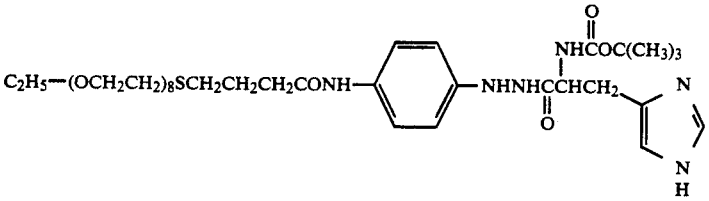

(I-40)

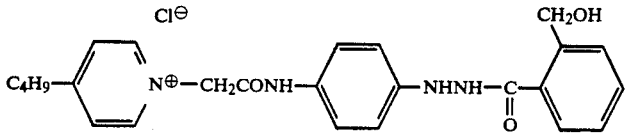

(I-41)

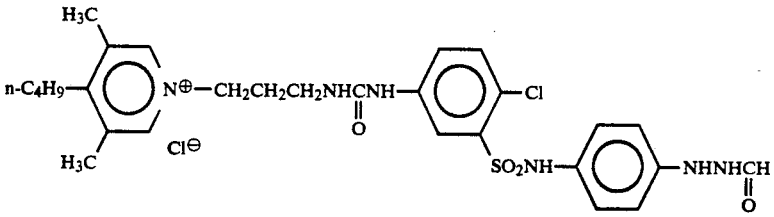

(I-42)

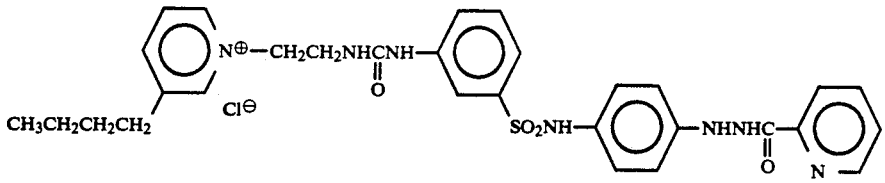

The amount of compound represented by formula (I) in the photographic material of the present invention is preferably from $1\times10^{-6}$ to $5\times10^{-2}$ mol, especially preferably from $1\times10^{-5}$ to $2\times10^{-2}$ mol, per mol of silver halide therein.

The compound of formula (I) of the present invention can be dissolved for use in a suitable watermiscible organic solvent, for example, alcohols (e.g., methanol, ethanol, propanol, fluorinated alcohols), ketones (e.g., acetone, methyl ethyl ketone), dimethylformamide, dimethylsulfoxide or methyl cellosolve.

If desired, it may be formed into an emulsified dispersion by a well-known emulsification and dispersion method in which it is dissolved in an oil such as dibutyl phthalate, tricresyl phosphate, glyceryl triacetate or diethyl phthalate or in an auxiliary solvent such as ethyl acetate or cyclohexanone. The resulting solution is mechanically emulsified and dispersed. Further, it may be dispersed in water with a redox compound by a well-known solid dispersion method such as a ball mill dispersion method, a colloid mill dispersion method or an ultrasonic dispersion method.

The halide composition of the silver halide emulsion to be used in the present invention is silver chlorobromide or silver chloroiodobromide having a silver chloride content of 50 mol% or more (preferably 60 mol% or more) and a silver iodide content of 5 mol% or less (preferably 2 mol% or less).

For preparing the silver halide emulsion for use in the present invention, various methods known in the technical field of silver halide emulsions may be employed. For instance, they may be prepared in accordance with the methods described in P. Glafkides, *Chimi et Physique Photographique* (published by Paul Montel, 1976); G.F. Duffin, *Photographic Emulsion Chemistry* (published by The Focal Press, 1966); and V.L. Zelikman et al, *Making and Coating Photographic Emulsion* (published by The Focal Press, 1964).

The silver halide emulsion for use in the present invention contains an iridium salt and/or rhodium salt Especially preferred is incorporation of both such salts into the emulsion.

The rhodium salts suitable in the present invention include rhodium trichloride and ammonium hexachlororhodate(III). Among these, ammonium hexachlororhodate(III) is particularly preferred. The time for addition of the rhodium salt into the emulsion of the present invention may be any time during preparation of the emulsion and before the completion of the first ripening of the emulsion. Especially preferred is addition of rhodium salt during formation of the emulsion grains. The amount of the salt to be added is preferably from $1\times10^{-8}$ to $8\times10^{-6}$ mol and more preferably from $5\times10^{-8}$ to $2\times10^{-6}$ mol, per mol of silver.

The iridium salts suitable in the present invention include iridium trichloride, iridium tetrachloride, potassium hexachloroiridate(III), potassium hexachloroiridate(IV) and ammonium hexachloroiridate(III). Among these, potassium hexachloroiridate(III), potassium hexachloroiridate(IV) and ammonium hexachloroiridate(III) are particularly preferred. The amount of the salt to be added is preferably from $1\times10^{-8}$ mol to $1\times10^{-5}$ mol and from $5\times10^{-8}$ to $5\times10^{-6}$ mol, per mol of silver. The method for adding the salt is preferably the same as that for the above-mentioned rhodium salt.

The silver halide grains for use in the present invention are preferably fine grains having a mean grain size of 0.7 μm or less, more preferably 0.5 μm or less. Regarding grain size distribution, the grains are desired to be monodispersed. More preferably, 90% by number or more of all grains in the emulsion have a grain size falling within the range of the mean grain size±40%, especially preferably±20%.

The silver halide grains are desirably regular crystalline ones such as cubic or octahedral grains, but are not limited to those forms. They may also be irregular crystalline in form such as spherical or tabular grains, or they may be composites of these forms.

The silver halide grains of the present invention can be prepared by a system for reacting a water-soluble silver salt (e.g., an aqueous silver nitrate solution) and water soluble halides, such as a single jet method, a double jet method and combination of them. As one type of double jet method, suitable is a controlled double jet method in which the pAg value in the liquid phase of the forming silver halide grains is kept constant. If desired, a so-called silver halide solvent such as ammonia, thioether or tetra-substituted ureas may be used in forming the silver halide grains. The controlled double jet method or a method using such a silver halide solvent is an effective means for forming silver halide grains having a regular crystalline form and having a narrow grain size distribution.

The silver halide emulsion of the present invention is gold-sensitized and sulfur-sensitized.

For gold-sensitization of the emulsion, various gold salts are used as a gold-sensitizer, including, for example, potassium chloroaurate, potassium auricthiocyanate and auric trichloride. Specific examples of these sensitizers are described in U.S. Pat. Nos. 2,399,083 and 2,642,361.

The sulfur-sensitizing agents to be used in the present invention for sulfur-sensitization of the emulsion include sulfur compounds contained in gelatin as well as various other sulfur compounds such as thiosulfates, thioureas, thiazoles and rhodanines. Specific examples of these sensitizers are described in U.S. Pat. Nos. 1,574,944, 2,278,947, 2,410,689, 2,728,668, 3,501,313, and 3,656,955. Preferred are thiosulfates and thiourea compounds.

The amount of each of the gold-sensitizer and sulfur sensitizer to be added is preferably from $1\times10^{-7}$ to $1\times10^{-2}$ mol, more preferably from $1\times10^{-5}$ to $1\times10^{-3}$ mol, per mol of silver.

The molar ratio of the gold-sensitizer and the sulfur-sensitizer may be preferably from ⅓ to 3/1, more preferably from ½ to 2/1.

The silver halide emulsion of the present invention can contain spectral sensitizing dyes (for example, cyanine dyes, merocyanine dyes) for the purpose of elevating sensitivity. Suitable for this purpose are cyanine dyes, merocyanine dyes, complex cyanine dyes, complex merocyanine dyes, holopolar cyanine dyes, hemicyanine dyes, styryl dyes and hemioxonole dyes. Especially suitable are cyanine dyes, merocyanine dyes and complex merocyanine dyes.

These sensitizing dyes may be used singly, but a combination of these dyes is preferred for the purpose of satisfactorily attaining the intended spectral sensitivity and for the purpose of supersensitization. Supersensitization may also be effected by adding dyes which do not have any spectral sensitizing activity by themselves or substances which do not substantially absorb visible rays to the emulsion along with sensitizing dyes Useful sensitizing dyes, combinations of dyes for displaying supersensitization and substances of displaying supersensitization are described also in *Research Disclosure*, Vol. 176, Item No. 17643 (published December, 1978), page 23, IV-A to IV-J.

Sensitizing dyes may be added to the silver halide emulsion in any stage before coating the emulsion. For instance, they may be added thereto during the step of forming silver halide grains, during the step of physical ripening of the grains or during the step of chemical ripening of the grains or may also be added to the emulsion just before coating The amount of the sensitizing dyes to be added to the emulsion of the present invention is preferably from $1\times10^{-6}$ to $1\times10^{-1}$ mol, more preferably from $5\times10^{-5}$ to $1\times10^{-2}$ mol, per mol of silver.

The photographic material of the present invention may contain various dyes and ultraviolet absorbing dyes such as pyrazolone-benzylidyne dyes, for the purpose of anti halation, anti-irradiation, adjustment of sensitivity and change of spectral sensitivity characteristics. The amount of such dyes to be added is generally from 5 mg to 400 m, preferably from 10 mg to 300 mg, per $m^2$ of the material.

The photographic material of the present invention can contain various compounds for the purposes of preventing fog and of stabilizing photographic characteristics during manufacture, storage or photographic processing of the material. For instance, suitable for these purposes are many compounds which are known as anti-foggants or stabilizers, such as azoles (e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles), mercaptopyrimidines, mercaptotriazines (e.g., thioketo compounds such as oxazolinethione), azaindenes (e.g., triazaindenes, tetraazaindenes, especially, 4-hydroxy-substituted-1,3,3a,7-tetraazaindenes, pentaazaindenes), benzenethiosulfonic acids, benzenesulfinic acids, benzenesulfonic acid amides, and hydroquinone derivatives. Of them, preferred are benzotriazoles (e.g., 5-methylbenzotriazole), nitroindazoles (e.g., 5-nitroindazole) and hydroquinone derivatives (e.g., hydroquinone, methylhydroquinone). These compounds may be incorporated into processing solutions to be used for processing the photographic material of the present invention.

The photographic material of the present invention contains an inorganic or organic hardening agent in the photographic emulsion layers or in other hydrophilic colloid layers. For instance, suitable are chromium salts (e.g., chromium alum, chromium acetate), aldehydes (e.g., formaldehyde, glyoxal, glutaraldehyde), N-methylol compounds (e.g., dimethylolurea, methylol dimethylhydantoin), dioxane derivatives (e.g., 2,3-dihydroxydioxane), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine), mucohalogenic acids (e.g., mucochromic acid, mucophenoxychromic acid), N-carbamoylpyridinium salts, and haloamidinium salts (e.g., 1-(1-chloro-1 pyridinomethylene pyrrolidinium-2-naphthalenesulfonate). They may be incorporated into the layers singly or in combination thereof. Above all, especially preferred are the active vinyl compounds described in JP-A-53-41221, JP-A-53-57257 and JP-A-59 162546 and active halides described in U.S. Pat. No. 3,325,287.

The photographic material may contain various surfactants in the photographic emulsion layers or in other hydrophilic colloid layers, for the purpose of aiding coating, improving the sliding property, antistatic property, emulsification and dispersion, preventing adhesion (i.e., adhesion between surfaces of the materials) and improving photographic properties (e.g., promotion of developability, and elevation of contrast and sensitization).

For instance, suitable surfactants include nonionic surfactants such as saponins (steroid type), alkylene oxide derivatives (e.g., polyethylene glycol, polyethylene glycol/polypropylene glycol condensates, polyethylene glycol alkyl ethers, polyethylene glycol esters, polyethylene glycol sorbitan esters, polyalkylene glycol alkylamines, silicone-polyethylene oxide adducts), glycidol derivatives (e.g., alkenylsuccinic acid polyglycerides, alkylphenol polyglycerides), fatty acid esters of polyalcohols, and alkyl esters of saccharides; anionic surfactants containing acidic groups such as a carboxyl group, a sulfo group, a phospho group, a sulfate group or a phosphate group, for example, alkylcarboxylic acid salts, alkylsulfonic acid salts, alkylbenzenesulfonic acid salts, alkylnaphthalenesulfonic acid salts, alkylsulfate esters, alkylphosphate esters, N-acyl-N-alkyltaurins, sulfosuccinate esters, sulfoalkylpolyoxyethylene alkylphenyl ethers, and polyoxyethylene alkylphosphates; amphoteric surfactants such as amino acids, aminoalkylsulfonic acids, aminoalkylsulfates or phosphates, alkylbetains, and amine oxides; and cationic surfactants such as alkylamine salts, aliphatic or aromatic quaternary ammonium salts, heterocyclic quaternary ammonium salts (e.g., pyridiniums, imidazoliums), and aliphatic or heterocyclic phosphonium or sulfonium salts.

Where surfactants are used as an antistatic agent in preparing the photographic material of the present invention, preferred are fluorine-containing surfactants (such as those described in U.S. Pat. No. 4,201,586 and JP-A-60-80849).

The photographic material of the present invention may contain a dispersion of a water-soluble or sparingly water-soluble synthetic polymer for the purpose of improving the dimension stability of the material. For instance, suitable are polymers or copolymers composed of monomer or comonomer components of alkyl (meth)acrylates, alkoxyalkyl (meth)acrylates, (meth)acrylamides, vinyl esters, glycidyl (meth)acrylates, acrylonitrile and/or styrenes. These components may optionally be used with acrylic acids, methacrylic acids, $\alpha,\beta$-unsaturated dicarboxylic acids and/or styrenesulfonic acids.

The photographic material of the present invention can contain a compound having acidic group(s) in the photographic emulsion layers or in other hydrophilic colloid layers. The compounds having acidic group(s) which may be included in the material include organic acids such as salicylic acid or ascorbic acid, as well as polymers and copolymers composed of, as repeating units, acid monomers of acrylic acid, maleic acid and/or phthalic acid. Of them, especially preferred are ascorbic acid, as a low molecular weight compound, and a water-dispersing latex of a copolymer composed of an acid monomer such as acrylic acid and a crosslinking monomer having two or more unsaturated groups such as divinyl benzene, as a high molecular weight compound.

The binder or protective colloid in the emulsion layers and other hydrophilic colloid layers constituting the photographic material of the present invention is advantageously a gelatin such as a lime-processed gelatin or acid-processed gelatin. Any other hydrophilic colloid may also be used. For instance, suitable are gelatin derivatives, graft polymers of gelatin and other polymers; proteins such as albumin or casein; cellulose derivatives such as hydroxyethyl cellulose, carboxymethyl cellulose and cellulose sulfate; saccharide derivatives such as starch derivatives; and synthetic hydrophilic high molecular weight compounds of homo- or co-polymers, such as polyvinyl alcohol, polyacrylic acid, polyacrylamide, polymethacrylic acid, polyvinyl imidazole and polyvinyl pyrazole.

Hydrophilic colloid layers other than silver halide emulsion layers constituting the photographic material of the present invention include a surface protective layer, an interlayer, a filter layer, an antihalation layer and an antistatic layer.

The hydrophilic colloid layers such as surface protective layer may contain a mat agent for the purpose of preventing (i.e., adhesion of surfaces). Suitable mat agents include fine grains of homopolymers of polymethyl methacrylate, copolymers of methyl methacrylate and methacrylic acid, and starch, silica and magnesium oxide, such as those described in U.S. Pat. Nos. 2,701,245, 2,992,101, 4,142,894, and 4,396,706.

The surface protective layer may contain silicone compounds as described in U.S. Pat. Nos. 3,489,576 and 4,047,958; colloidal silica as described in JP-B-56-23139 (the term "JP-B" as used herein means an "examined Japanese patent publication"); as well as paraffin wax or higher fatty acid esters.

The emulsion layers and other hydrophilic colloid layers constituting the photographic material of the present invention can contain polyols such as trimethylolpropane, pentane-diol, butane-diol, ethylene glycol and glycerin, as plasticizers.

Further, they may also contain a brightening agent, a development accelerator, an antioxidant, a pH adjusting agent, a thickener and an antistatic agent.

The support of the photographic material of the present invention may be cellulose triacetate, cellulose diacetate, nitrocellulose, polystyrene, or polyethylene terephthalate. Of them, especially preferred is polyethylene terephthalate. The support may be surfacetreated by corona discharging or may also be subjected to a subbing treatment by any known method, if desired.

A water-proofing layer containing a polyvinylidene chloride polymer may also be provided for the purpose of elevating dimensional stability against variation of the dimension due to fluctuation of the ambient temperature and humidity.

The developer to be used for forming a high contrast negative image in the silver halide photographic material of the present invention may have a pH value of from 10.0 to 11.5, preferably from 10.2 to 11.5, which is lower than that of a conventional developer used in a conventional hydrazine-containing developing system for increasing contrast. In addition, in developing the silver halide photographic material of the present invention with such a developer, it is substantially unnecessary to incorporate an amine compound having the function of promoting the contrast-elevating activity of hydrazines into the developer. That is, it is preferable that the content of the amine compound is preferably 0.5 g or less and particularly preferably 0 g, per liter of the developer. After the material of the present invention is developed with an amine-free developer having the abovementioned pH range, a high contrast negative image is obtained.

The term "a superadditive developer" used in the present invention is described in detail in T.H. James, *The Theory of the Photographic Process*, 4th ed., The MacMillan Publishing Co., Inc., pages 432 to 436, "Superadditivity".

The developer may contain a dihydroxybenzene compound as a developing agent, with 3-pyrazolidones (e.g., a 1-phenyl-3-pyrazolidone) or p-aminophenol as an auxiliary developing agent, and a sulfite as a preservative.

Suitable dihydroxybenzene developing agents include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Especially preferred is hydroquinone.

Suitable 1-phenyl-3-pyrazolidone auxiliary developing agents include 1-phenyl-3-pyrazolidone, 1-phenyl-4,4-dimethyl-3-pyrazolidone, 1-phenyl-4-methyl-4-hydroxymehtyl-3-pyrazolidone, 1-phenyl-4,4-dihydroxymethyl-3pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Suitable p-aminophenol auxiliary developing agents include N-methyl-p-aminophenol, p-aminophenol, N-(β-hydroxyethyl) p aminophenol, 2-methyl-p-aminophenol, and p-benzylaminophenol.

The developer preferably contains the dihydroxybenzene developing agent, generally in an amount of from 0.2 to 0.8 mol/liter, and it contains the auxiliary developing agent in an amount of 0.06 mol/liter or less.

The sulfite preservative include compounds giving free sulfite ions such as sodium sulfite, potassium sulfite, lithium sulfite, ammonium sulfite, sodium bisulfite, potassium metabisulfite and formaldehyde-sodium bisulfite. The amount of the sulfite to be added to the developer is preferably from 0.15 to 1.2 mol/liter, especially preferably from 0.3 to 0.8 mol/liter.

In order to set the pH value of the developer to a determined value, one may use an alkaline agent such as sodium hydroxide, potassium hydroxide, sodium carbonate, potassium carbonate, sodium tertiary phosphate, potassium tertiary phosphate, sodium silicate and potassium silicate, as well as a pH adjusting agent and a buffer.

Other additives in addition to the above may be added to the developer, including, for example, a compound such as boric acid or borax; a development inhibitor such as sodium bromide, potassium bromide or potassium iodide; an organic development inhibitor such as a mercapto compound (e.g., 1-phenyl-5-mercaptotetrazole, sodium 2-mercaptobenzimidazole-5-sulfonate), indazole compounds (e.g., 5-nitroindazole), benzimidazole compounds (e.g., 5-nitrobenzimidazole), triazole compounds (e.g., 5-methylbenzotriazole); an organic solvent such as ethylene glycol, diethylene glycol, triethylene glycol, dimethylformamide, methyl cellosolve, ethanol, methanol; and a surfactant, a chelating agent, a color toning agent, a hard water softener, a development accelerator, a defoaming agent, a hardening agent and a silver stain inhibitor.

When the photographic material of the present invention is developed with the above-mentioned developer, the development temperature is within the range of generally from 18° C. to 50° C., preferably from 25° C. to 40° C.; and the development time is within the range of generally from 10 seconds to 180 seconds, preferably from 10 seconds to 60 seconds.

Suitable fixing agents to be used for processing the photographic material of the present invention include sodium thiosulfate, ammonium thiosulfate and sodium thiocyanate. In addition, other organic sulfur compounds known to be effective as a fixing agent may also be used. Above all, preferred is sodium thiosulfate in view of its fixing rate.

The amount of the fixing agent in the fixer is preferably from 0.1 to 5 mol/liter.

The fixer may contain, as a hardening agent, a water-soluble aluminium compound (e.g., aluminium sulfate, aluminium chloride, potassium alum). The amount of the aluminium salt therein is preferably from 0.2 to 1.0 g/liter as aluminium.

The pH value for fixation is generally 3.8 or more, preferably from 4.0 to 5.5. For pH adjustment in fixation, one may use acetic acid or dibasic acids or their salts (e.g., tartaric acid, citric acid, sodium citrate, sodium tartrate).

The fixer may further contain, if desired, a preservative (e.g., sulfites, bisulfites), a pH buffer (e.g., acetic acid, boric acid), a pH adjusting agent (e.g., ammonia, sulfuric acid), an image stabilizer (e.g., potassium iodide), and a chelating agent.

The temperature and time for fixation may be same as those for the previously described development.

The fixed photographic material is rinsed in water. The rinsing water may contain a fungicide (e.g., compounds described in Horiguchi, *Bactericidal and Fungicidal Chemistry*; and JP-A-62-115154), a rinsing accelerator (e.g., sulfites), and a chelating agent.

Rinsing is effected for the purpose of almost completely removing the silver salts which are dissolved by the previous fixation, and it is preferably effected at a temperature of from about 25° C. to 50° C. and for a period of time of from 10 seconds to 180 seconds.

After being rinsed, the material is dried. Drying is effected preferably at a temperature of from 30° C. to 80° C. The drying time may suitably be varied in accordance with the ambient circumstances, and it is generally from 5 seconds to 200 seconds.

The processing steps of development-fixationrinsing-drying to be applied to the photographic material of the present invention are advantageously carried out in a roller-conveying type automatic developing machine, which is generally employed in this technical field as an effective means. Suitable automatic developing machines include those described in, for example, U.S. Pat. Nos. 3,025,779 and 3,545,971.

The present invention will be explained in more detail by way of the following examples, which, however, are not intended to restrict the scope of the present invention.

EXAMPLE 1

An aqueous silver nitrate solution and an aqueous mixed solution of sodium chloride and potassium bromide (containing $5\times10^{-7}$ mol per mol of silver of potassium hexachloroiridate(III) and $2\times10^{-7}$ mol per mol of silver of ammonium hexachlororhodate(III)) were added to and blended with an aqueous gelatin solution kept at 55° C., over a period of 60 minutes by a double jet method. A silver chlorobromide emulsion comprising monodispersed cubic grains having a mean grain size of 0.3 μm resulted (silver bromide content: 30 mol%).

After completion of formation of the grains, the emulsion was washed with water by an ordinary method to remove soluble salts therefrom. Gelatin and then sodium chloride, potassium bromide and sodium hydroxide were added thereto so that the emulsion had pAg of 7.6 and pH of 6.0.

Then, $2\times10^{-5}$ mol per mol of silver of sodium thiosulfate and $3\times10^{-5}$ mol per mol of silver of potassium chloroaurate were added to the emulsion, which was thereby chemically sensitized at 60° C. for 40 minutes. Further, 0.1 mol% per mol of silver of potassium iodide solution was added thereto to effect halogen-conversion of the surfaces of the grains. As a stabilizer, was added $5\times10^{-3}$ mol per mol of silver of 4-hydroxy-6-methyl-1,3,3a,7-tetrazaindene; and as a sensitizing dye, was added $3\times10^{-4}$ mol per mol of silver of a compound having the following chemical structure. Thus, Emulsion A was prepared.

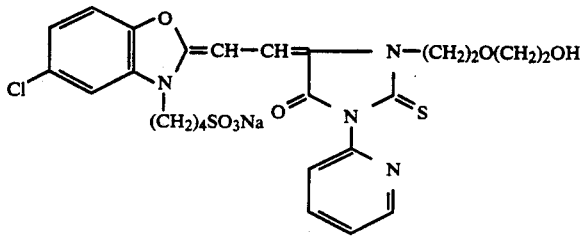

In the same manner as in preparation of Emulsion A, Emulsion B was prepared, except that potassium hexachloroiridate(III) and ammonium hexachlororhodate(III) were not added.

To each of Emulsion A and Emulsion B, was added a hydrazine compound of formula (I) or a hydrazine compound having one of the following chemical structures as comparative examples, as indicated in Table 1 below:

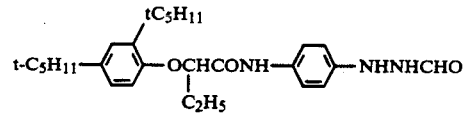

(a)

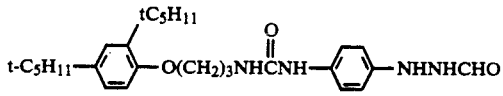

(b)

Further added to the emulsions were: $3\times10^{-3}$ mol per mol of silver of 5-methylbenzotriazole; $4\times10^{-4}$ mol per mol of silver of 1-phenyl-5-mercaptotetrazole; 0.8 g per $m^2$ of the polyethyl acrylate compound as described in the preparing formulation of U.S. Pat. No. 3,525,620, as a polymer latex; 40 mg per $m^2$ of sodium p-dodecylbenzenesulfonate, as a coating aid; and 100 mg per $m^2$ of 1,3-divinylsulfonyl-2-propanol, as a hardening agent. The thus-prepared emulsion was coated over a polyethylene terephthalate support in an amount of 3.2 g, as silver, per $m^2$.

Over the silver halide emulsion layer was coated a gelatin layer as a protective layer. The amount of gelatin in the protective layer was 1.2 g per $m^2$. The protective layer contained polymethyl methacrylate and methanol silica having a mean grain size of 3.4 μm, as a matting agent, along with silicone oil and sodium p-dodecylbenzenesulfonate.

In this way, Samples Nos. 1 to 16 as shown in Table 1 below were prepared.

TABLE 1

| Sample No. | Emulsion | Hydrazine Compound | |
|---|---|---|---|
| | | Compound | Amount |
| 1 | A | — | — |
| 2 | A | I-4 | $3 \times 10^{-4}$ mol/mol-Ag |
| 3 | A | I-4 | $6 \times 10^{-4}$ mol/mol-Ag |
| 4 | A | I-5 | $6 \times 10^{-4}$ mol/mol-Ag |
| 5 | A | I-8 | $6 \times 10^{-4}$ mol/mol-Ag |
| 6 | A | I-11 | $6 \times 10^{-4}$ mol/mol-Ag |
| 7 | A | comparative compound (a) | $6 \times 10^{-4}$ mol/mol-Ag |
| 8 | A | comparative compound (b) | $6 \times 10^{-4}$ mol/mol-Ag |
| 9 | B | — | — |
| 10 | B | I-4 | $3 \times 10^{-4}$ mol/mol-Ag |
| 11 | B | I-4 | $6 \times 10^{-4}$ mol/mol-Ag |
| 12 | B | I-5 | $6 \times 10^{-4}$ mol/mol-Ag |
| 13 | B | I-8 | $6 \times 10^{-4}$ mol/mol-Ag |
| 14 | B | I-11 | $6 \times 10^{-4}$ mol/mol-Ag |
| 15 | B | comparative compound (a) | $6 \times 10^{-4}$ mol/mol-Ag |
| 16 | B | comparative compound (b) | $6 \times 10^{-4}$ mol/mol-Ag |

These samples were exposed with a tungsten lamp of 3200° K. through a sensitometric wedge for 5 seconds and then developed with a developed having the composition shown below, at 34° C. for 30 seconds. These samples were then fixed, rinsed and dried. (For processing the samples in this way, an automatic developing machine of LD-281Q Model (manufactured by Dai-Nippon Screen Co.) was used.)

| Composition of Developer | |
|---|---|
| Hydroquinone | 45.0 g |
| 4-Methyl-4-hydroxymethyl-1-phenyl-3-pyrazolidone | 0.4 g |
| Sodium Hydroxide | 10.0 g |
| Potassium Hydroxide | 25.0 g |
| Boric Acid | 10.0 g |
| Potassium Sulfite | 90.0 g |
| Potassium Bromide | 6.0 g |
| 5-Methylbenzotriazole | 0.6 g |
| Sodium 2-Mercaptobenzimidazole-5-sulfonate | 0.3 g |
| Sodium 3-(5-mercaptotetrazole)benzene-sulfonate | 0.2 g |
| Water to make | 1 liter (pH 10.7) |

The results obtained are shown in Table 2 below.

TABLE 2

| Sample No. | Sensitivity | Fog | γ Value | Dmax | |
|---|---|---|---|---|---|
| 1 | 100 | 0.04 | 5.6 | 3.6 | Comparison |
| 2 | 186 | 0.04 | 11.7 | 4.7 | Invention |
| 3 | 209 | 0.04 | 12.9 | 5.1 | Invention |
| 4 | 178 | 0.04 | 11.3 | 4.8 | Invention |
| 5 | 214 | 0.05 | 13.5 | 5.3 | Invention |
| 6 | 200 | 0.04 | 15.0 | 5.4 | Invention |
| 7 | 132 | 0.04 | 7.7 | 4.0 | Comparison |
| 8 | 141 | 0.04 | 8.4 | 4.3 | Comparison |
| 9 | 112 | 0.05 | 5.2 | 3.9 | Comparison |
| 10 | 200 | 0.12 | 8.4 | 4.1 | Comparison |
| 11 | 219 | 0.17 | 7.7 | 4.5 | Comparison |
| 12 | 204 | 0.15 | 8.4 | 4.9 | Comparison |
| 13 | 229 | 0.20 | 6.8 | 5.0 | Comparison |
| 14 | 214 | 0.13 | 7.9 | 4.5 | Comparison |
| 15 | 151 | 0.13 | 7.1 | 4.4 | Comparison |
| 16 | 166 | 0.11 | 9.0 | 4.6 | Comparison |

As an index of the contrast of the image formed in each sample, a γ value is shown. This value means the inclination of the line formed by linking the point of (fog+density 0.3) with the point of (fog+density 3.0) in the characteristic curve. The larger the γ value is, the higher the contrast of the image.

In Table 2, the sensitivity means a relative sensitivity to the sensitivity (100) of Sample No. 1, which corresponds to the reciprocal of the amount of exposure of giving a density of 1.5.

As is apparent from the results in Table 2 above that Samples Nos. 2 to 6 of the present invention each containing a hydrazine derivative of formula (I) along with Emulsion A had a hard photographic characteristic having a γ value of 10 or more and little fog, when processed with a developer having a low pH value. However, when Emulsion B was used, fog increased and the contrast of the formed image lowered.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein a silver halide emulsion in the emulsion layer contains at least one of an iridium salt and a rhodium salt and comprises a gold-sensitized and sulfur-sensitized silver chlorobromide emulsion or silver chloroiodobromide emulsion, having a silver chloride content of 50 mol% or more and a silver iodide content of 5 mol% or less, and the emulsion layer contains a hydrazine compound represented by formula (I):

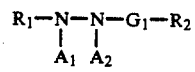

(I)

wherein $R_1$ represents an aliphatic group or an aromatic group, which contains a partial structure, $-O-(CH_2CH_2O)_n-$, $-O-(CH_2CH(CH_3)O)_n-$ or $-O-(CH_2CH(OH)CH_2O)_n$, wherein n is an integer of 3 or more, as a part of the $R_1$ substituent, or contains a quaternary ammonium cation as a part of the $R_1$ substituent; $G_1$ represents —CO—, —COCO—, —CS—, $-C(=NG_2R_2)-$, —SO—, $-SO_2-$ or $-P(O)(G_2R_2)-$, wherein $G_2$ represents at least one chemical bond selected from the group consisting of —O—, —S— or $-N(R_2)-$, and $R_2$ represents an aliphatic group, an aromatic group or a hydrogen atom, and when the molecule has a plurality of $R_2$ groups, they may be same as or different from each other; and one of $A_1$ and $A_2$ is a hydrogen atom, and the other is a hydrogen atom, an acyl group, an alkylsulfonyl group or an arylsulfonyl group.

2. The silver halide photographic material as claimed in claim 1, wherein $R_1$ in formula (I) represents at least one group selected from the group consisting of groups represented by formulae (2), (3), (4) and (5):

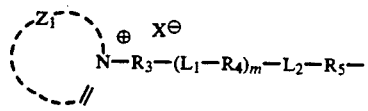

(2)

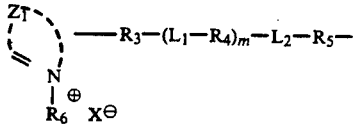

(3)

-continued

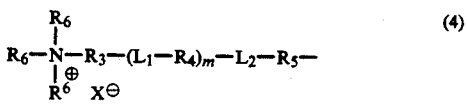

(4)

$$R_6-O-(L_3)_n-R_3-(L_1-R_4)_m-L_2-R_5- \quad (5)$$

where $L_1$ and $L_2$ each represents —$CONR_7$—, —$NR_7CONR_8$—, —$SO_2NR_7$— or —$NR_7SO_2NR_8$—, and they may be same as or different from each other;

$R_7$ and $R_8$ each represents a hydrogen atom, an alkyl group having from 1 to 6 carbon atoms, or an aryl group having from 6 to 10 carbon atoms;

m is 0 or 1;

$R_3$, $R_4$ and $R_5$ each represents a divalent aliphatic or aromatic group;

$Z_1$ represents an atomic group necessary for forming a nitrogen-containing aromatic ring;

$X^{\ominus}$ represents a counter anion, or a counter anion part when the intramolecular salt is formed;

$R_6$ represents an aliphatic group or an aromatic group; $Z_1$ and $R_6$ may be substituted with a substituent; in formula (4), the three $R_6$ groups may be same as or different from each other, or they may be bonded to each other to form a ring;

$L_3$ represents —$CH_2CH_2O$—, —$CH_2CH(CH_3)O$—, or —$CH_2CH(OH)CH_2O$—; and n has the same meaning as in formula (I).

3. The silver halide photographic material as claimed in claim 1, wherein $G_1$ in formula (I) is —CO— or $SO_2$—, and $A_1$ and $A_2$ in formula (I) are hydrogen atoms.

4. The silver halide photographic materials as claimed in claim 1, wherein the silver halide emulsion comprises both an iridium salt and a rhodium salt.

5. A method for forming a high-contrast negative image by the step of developing an imagewise exposed silver halide photographic material, wherein the development of the exposed photographic material is effected with a superadditive developer having a pH value of from 10.0 to 11.5 and comprising the following components:

(1) a hydroquinone developing agent, (2) at least on of a 3-pyrazolidone auxiliary developing agent and a p-aminophenol auxiliary developing agent, in an amount of 0.06 mol/liter or less, and (3) a sulfite ion in a concentration of from 0.3 to 0.8 mol/liter;

the exposed photographic material comprises a support having thereon at least one silver halide emulsion layer, wherein a silver halide emulsion in the emulsion layer contains at least one of an iridium salt and a rhodium salt and comprises a gold-sensitized and sulfur-sensitized silver chlorobromide emulsion or silver chloroiodobromide emulsion, having a silver chloride content of 50 mol% or more and a silver iodide content of 5 mol% or less, and the emulsion layer contains a hydrazine compound represented by formula (I):

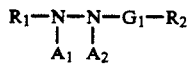

(I)

wherein $R_1$ represents an aliphatic group or an aromatic group, which contains a partial structure, —O $\leftarrow CH_2CH_2O)_n$—, —O $\leftarrow CH_2CH(CH_3)O)_n$— or —O $\leftarrow CH_2CH(OH)CH_2O)_n$—, wherein n is an integer of 3 or more, as a part of the $R_1$ substituent, or contains a quaternary ammonium cation as a part of the $R_1$ substituent; $G_1$ represents —CO—, —COCO—, —CS—, —$C(=NG_2R_2)$—, —SO—, —$SO_2$—or —$P(O)(G_2R_2)$—, wherein $G_2$ represents at least one chemical bond selected from the group consisting of —O—, —S— or —$N(R_2)$—, and $R_2$ represents an aliphatic group, an aromatic group or a hydrogen atom, and when the molecule has a plurality of $R_2$ groups, they may be same as or different from each other; and one of $A_1$ and $A_2$ is a hydrogen atom, and the other is a hydrogen atom, an acyl group, an alkylsulfonyl group or an arylsulfonyl group.

6. The method for forming a high-contrast negative image as claimed in claim 5, wherein the superadditive developer is substantially amine compound-free.

* * * * *